US009220300B1

(12) United States Patent
Vastano

(10) Patent No.: US 9,220,300 B1
(45) Date of Patent: Dec. 29, 2015

(54) CIGARETTE PUNCTURING DEVICE

(71) Applicant: Louis F. Vastano, East Providence, RI (US)

(72) Inventor: Louis F. Vastano, East Providence, RI (US)

( * ) Notice: Subject to any disclaimer, the term of this patent is extended or adjusted under 35 U.S.C. 154(b) by 0 days.

(21) Appl. No.: 14/083,851

(22) Filed: Nov. 19, 2013

(51) Int. Cl.
*A24F 13/24* (2006.01)

(52) U.S. Cl.
CPC ..... *A24F 13/24* (2013.01)

(58) Field of Classification Search
CPC ..... A24F 13/24; A24F 13/26
USPC ..... 131/252–255
See application file for complete search history.

(56) References Cited

U.S. PATENT DOCUMENTS

| | | | | | |
|---|---|---|---|---|---|
| 1,345,736 | A | * | 7/1920 | Bailey | 131/254 |
| 1,504,652 | A | * | 8/1924 | Sweet | 131/254 |
| 2,832,354 | A | * | 4/1958 | Miller | 131/254 |
| 3,158,157 | A | * | 11/1964 | Risk | 131/329 |
| 3,405,718 | A | | 10/1968 | Grassi | |
| 3,742,963 | A | | 7/1973 | Creamer | |
| 4,046,152 | A | | 9/1977 | Purdon | |
| 4,231,378 | A | | 11/1980 | Stevens | |
| D268,136 | S | | 3/1983 | Cervantes | |
| 6,314,645 | B1 | | 11/2001 | Wahl | |
| 2012/0160252 | A1 | | 6/2012 | Green | |

* cited by examiner

*Primary Examiner* — Richard Crispino
*Assistant Examiner* — Dionne Walls Mayes
(74) *Attorney, Agent, or Firm* — Kyle A. Fletcher, Esq.

(57) ABSTRACT

A puncturing assembly for selectively puncturing a cigarette includes a tubular housing that may insertably receive the cigarette. A plunger is operationally coupled to the tubular housing. The plunger may be urged by a user. A prong is coupled to the plunger. The prong may selectively pierce the cigarette. The cigarette delivers a reduced amount of nicotine to the user.

17 Claims, 2 Drawing Sheets

CIGARETTE PUNCTURING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of puncturing devices, more specifically, cigarette puncturing devices.

SUMMARY OF THE INVENTION

An embodiment of the disclosure meets the needs presented above by generally comprising a tubular housing that may insertably receive the cigarette. A plunger is operationally coupled to the tubular housing. The plunger may be urged by a user. A prong is coupled to the plunger. The prong may selectively pierce the cigarette. The cigarette delivers a reduced amount of nicotine to the user.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 2:
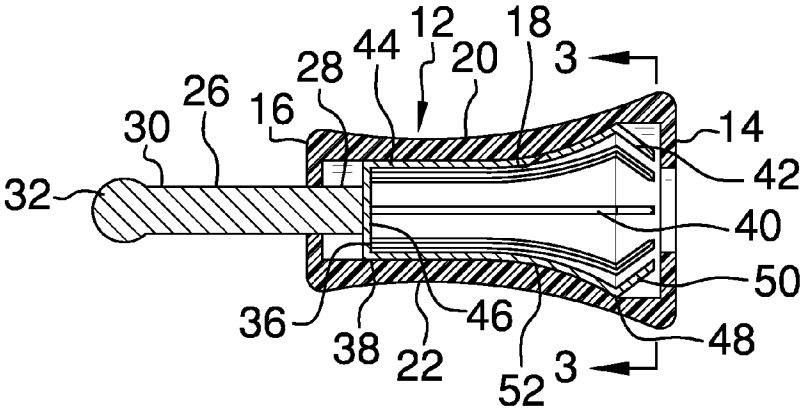
FIG. 2 is a cross sectional view taken along line 2-2 of FIG. 1 of an embodiment of the disclosure.
Figure 3:
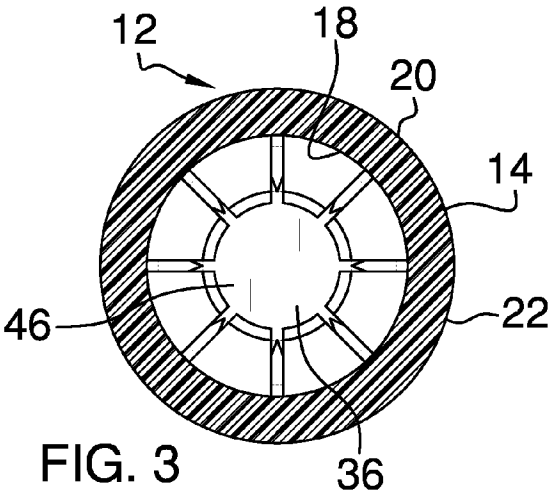
FIG. 3 is a cross sectional view taken along line 3-3 of FIG. 2 of an embodiment of the disclosure.
Figure 1:
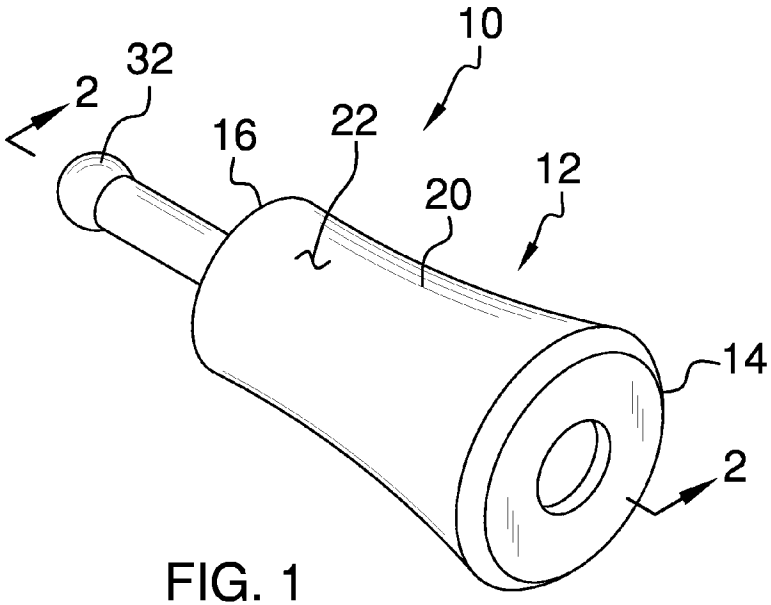
FIG. 1 is a perspective view of a puncturing assembly according to an embodiment of the disclosure.
Figure 4:
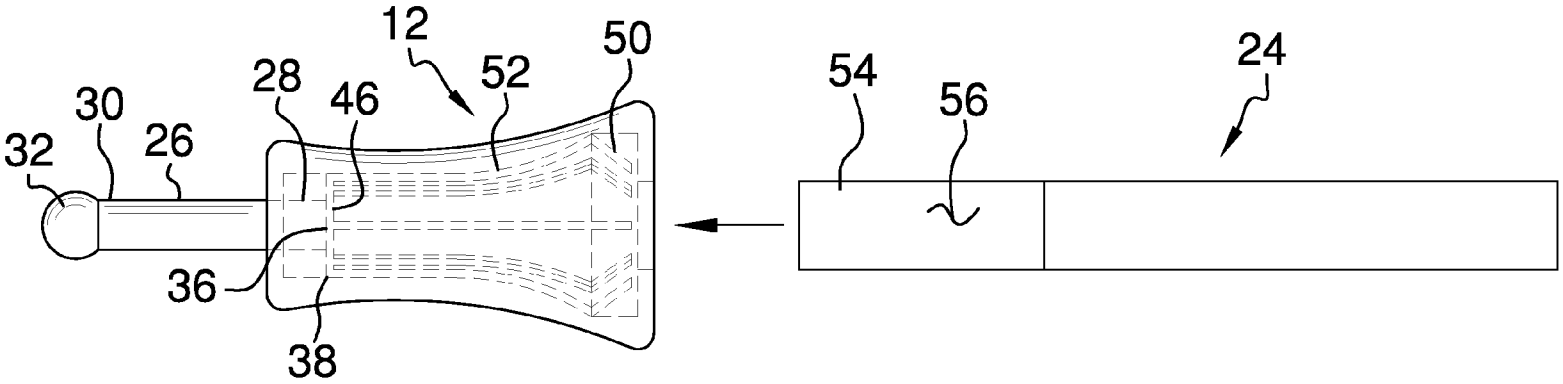
FIG. 4 is a right side phantom view of an embodiment of the disclosure.
Figure 5:
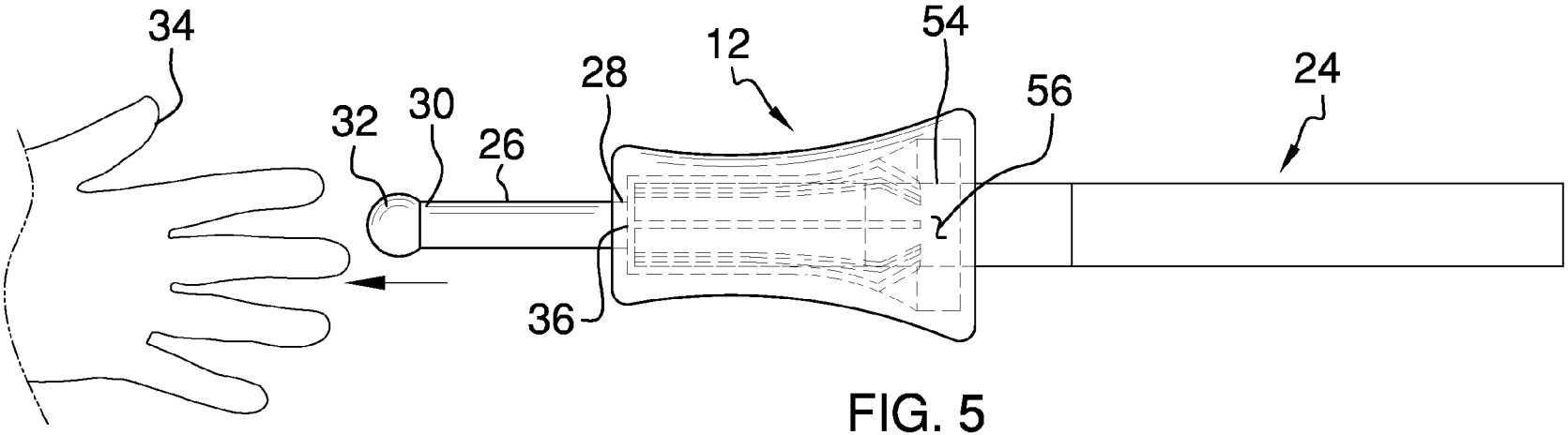
FIG. 5 is an in-use view of an embodiment of the disclosure.

As best illustrated in FIGS. 1 through 5, the puncturing assembly 10 (hereinafter assembly) generally comprises a tubular housing 12 that is elongated along a longitudinal axis extending through an open front end 14 and an open back end 16 of the tubular housing 12. The open front end 14 of the tubular housing 12 has a diameter is greater than a diameter of the open back end 16 of the tubular housing 12. Moreover, the tubular housing 12 has a bell shape that may have a diameter ranging between a minimum diameter between 6 mm and 13 mm and a maximum diameter between 2 cm and 3 cm. Further, the tubular housing 12 may have a length between 5 cm and 8 cm. An inner surface 18 of an outer wall 20 of the tubular housing 12 is curvilinear with an outer surface 22 of the outer wall 20 of the tubular housing 12. Additionally, an interior of the tubular housing 12 is bell shaped. The open front end 14 of the tubular housing 12 insertably receives a cigarette 24 so the cigarette 24 is positioned within the interior of the tubular housing 12.

A plunger 26 is elongated along a longitudinal axis extending through a front end 28 and a back end 30 of the plunger 26. The plunger 26 is slidably coupled to the tubular housing 12. Moreover, a front end 28 of the plunger 26 is positioned within the open back end 16 of the tubular housing 12. The plunger 26 may have a length between 3 cm and 4 cm. Lastly, a ball 32 is coupled to the back end 30 of the plunger 26 so the ball 32 may be gripped by a user 34.

A circular plate 36 is coupled to the front end 28 of the plunger 26. The circular plate 36 is positioned within an interior of the tubular housing 12. Continuing, an outer edge 38 of the circular plate 36 abuts the inner surface 18 of the outer wall 20 of the tubular housing 12. Lastly, the circular plate 36 may have a diameter between 4 mm and 11 mm.

A prong 40 is elongated along a longitudinal axis extending through a front end 42 and a back end 44 of the prong 40. The back end 44 of the prong 40 is coupled to a front side 46 of the circular plate 36 proximate the outer edge 38 of said circular plate 36. Continuing, the prong 40 extends forwardly from the circular plate 36. The prong 40 coextensively abuts the inner surface 18 of the outer wall 20 of the tubular housing 12. Finally, the prong 40 may have a length between 4 cm and 7 cm.

The prong 40 further comprises a bend 48 proximate the front end 42 of the prong 40. A front portion 50 of the prong 40 forms an obtuse inside angle with respect to a rear portion 52 of the prong 40. The front portion 50 of the prong 40 may have a length between 0.5 cm and 1 cm. Additionally, the rear portion 52 of the prong 40 may have a length between 3.5 cm and 6 cm. The rear portion 52 of the prong 40 is curved so the rear portion 52 of the prong 40 is biased toward the inner surface 18 of the outer wall 20 of the tubular housing 12. Additionally, the front end 42 of the prong 40 tapers to a sharpened point. The prong 40 is one of a plurality of the prongs 40. Lastly, the plurality of prongs 40 is evenly distributed around an entire circumference of the circular plate 36.

The plunger 26 is positionable in a piercing position. The user 34 urges the back end 30 of the plunger 26 rearwardly away from the open back end 16 of the tubular housing 12. Moreover, the front end 42 of the plurality of prongs 40 is urged toward each other as the plurality of prongs 40 slides rearwardly along the inner surface 18 of the outer wall 20 of the tubular housing 12. The plunger 26 may slide a distance between 1 cm and 2 cm when the plunger 26 is positioned in the piecing position. The plunger 26 is positionable in a releasing position. Continuing, the user 34 urges the back end 30 of the plunger 26 forwardly toward the open back end 16 of the tubular housing 12. Conversely, the plunger 26 is possibly made of a spring steel, and is able to return forwardly on its own in order to return the plunger 26 to its original start position. The front end 42 of the plurality of prongs 40 moves away from each other as the plurality of prongs 40 slides forwardly along the inner surface 18 of the outer wall 20 of the tubular housing 12.

In use, a rear end 54 of the cigarette 24 is inserted in the open front end 14 of the tubular housing 12. The plunger 26 is positioned in the piercing position. Continuing, the front end 42 of the plurality of prongs 40 pierces an outer surface 56 of the cigarette 24 around an entire circumference of the rear end 54 of the cigarette 24. When the user 34 smokes the cigarette 24 the increased air flow through the pierced outer surface 56 of the cigarette 24 delivers a reduced amount of nicotine to the user 34.

With respect to the above description, it is to be realized that the optimum dimensional relationship for the various components of the assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A puncturing assembly for selectively puncturing a cigarette, said assembly comprising:

a tubular housing configured to insertably receive a cigarette;

a plunger operationally coupled to said tubular housing wherein said plunger is configured to be urged by a user;

a prong coupled to said plunger wherein said prong is configured to selectively pierce the cigarette, and wherein the cigarette delivers a reduced amount of nicotine to the user;

wherein an open front end of said tubular housing has a diameter, which is greater than a diameter of an open back end of said tubular housing, and wherein said tubular housing is bell shaped;

wherein a back end of said prong is coupled to a front side of a circular plate proximate an outer edge of said circular plate, and wherein said prong extends forwardly from said circular plate such that said prong coextensively abuts an inner surface of an outer wall of said tubular housing;

wherein said plunger is positionable in a piercing position, wherein the user urges a back end of said plunger rearwardly away from an open back end of said tubular housing, and wherein a front end of a plurality of prongs is urged toward each other as said plurality of prongs slides rearwardly along an inner surface of an outer wall of said tubular housing.

2. The assembly according to claim 1 wherein said tubular housing is elongated along a longitudinal axis extending through an open front end and an open back end of said tubular housing.

3. The assembly according to claim 1 wherein an inner surface of an outer wall of said tubular housing is curvilinear with an outer surface of said outer wall of said tubular housing, and wherein an interior of said tubular housing is bell shaped.

4. The assembly according to claim 1 wherein an open front end of said tubular housing insertably receives the cigarette, and wherein the cigarette is positioned within an interior of said tubular housing.

5. The assembly according to claim 1 wherein said plunger is elongated along a longitudinal axis extending through a front end and a back end of said plunger.

6. The assembly according to claim 1 wherein said plunger is slidably coupled to said tubular housing, and wherein a front end of said plunger is positioned within an open back end of said tubular housing.

7. The assembly according to claim 1 wherein a ball is coupled to a back end of said plunger, and wherein said ball is configured to be gripped by the user.

8. The assembly according to claim 1 wherein a circular plate is coupled to a front end of said plunger, and wherein said circular plate is positioned within an interior of said tubular housing.

9. The assembly according to claim 1 wherein said prong is elongated along a longitudinal axis extending through a front end and a back end of said tubular housing.

10. The assembly according to claim 1 wherein a bend is proximate a front end of said prong, and wherein a front portion of said prong forms an obtuse inside angle with respect to a rear portion of said prong.

11. The assembly according to claim 1 wherein a rear portion of said prong is curved, and wherein said rear portion of said prong is biased toward an inside surface of an outer wall of said tubular housing.

12. The assembly according to claim 1 wherein a front end of said prong tapers to a sharpened point.

13. The assembly according to claim 1 wherein said prong is one of a plurality of said prongs.

14. The assembly according to claim 13 wherein said plurality of prongs is evenly distributed around an entire circumference of a circular plate.

15. The assembly according to claim 1 wherein said plunger is positionable in a releasing position, wherein the user urges a back end of said plunger forwardly or said plunger is spring-loaded such that said plunger shall move towards an open back end of said tubular housing, and wherein a front end of a plurality of prongs moves away from each other as said plurality of prongs slides forwardly along an inner surface of an outer wall of said tubular housing.

16. The assembly according to claim 1 wherein a rear end of the cigarette is inserted in an open front end of said tubular housing, wherein said plunger is positioned in a piercing position, and wherein a front end of a plurality of said prongs pierces an outer surface of the cigarette around an entire circumference of the rear end of the cigarette.

17. A puncturing assembly for selectively puncturing a cigarette, said assembly comprising:

a tubular housing elongated along a longitudinal axis extending through an open front end and an open back end of said tubular housing, said open front end of said tubular housing having a diameter being greater than a diameter of said open back end of said tubular housing, wherein said tubular housing is bell shaped, wherein an inner surface of an outer wall of said tubular housing is curvilinear with an outer surface of said outer wall of said tubular housing, wherein an interior of said tubular housing is bell shaped, wherein said open front end of said tubular housing insertably receives a cigarette, and wherein the cigarette is positioned within an interior of said tubular housing;

a plunger elongated along a longitudinal axis extending through a front end and a back end of said plunger, said plunger being slidably coupled to said tubular housing wherein a front end of said plunger is positioned within said open back end of said tubular housing;

a ball coupled to said back end of said plunger wherein said ball is configured to be gripped by a user;

a circular plate coupled to said front end of said plunger wherein said circular plate is positioned within an interior of said tubular housing;

a prong elongated along a longitudinal axis extending through a front end and a back end of said prong, said back end of said prong being coupled to a front side of a circular plate proximate an outer edge of said circular plate, wherein said prong extends forwardly from said circular plate such that said prong coextensively abuts said inner surface of said outer wall of said tubular housing, wherein said prong further comprises a bend proximate said front end of said prong wherein a front portion of said prong forms an obtuse inside angle with respect to a rear portion of said prong, said rear portion of said prong being curved, wherein said rear portion of said prong is biased toward said inside surface of said outer wall of said tubular housing, and wherein said front end of said prong tapers to a sharpened point, said prong being one of a plurality of said prongs;

said plurality of prongs being evenly distributed around an entire circumference of said circular plate;

said plunger being positionable in a piercing position, wherein the user urges said back end of said plunger rearwardly away from said open back end of said tubular housing, wherein said front end of said plurality of prongs is urged toward each other as said plurality of prongs slides rearwardly along said inner surface of said outer wall of said tubular housing;

wherein said plunger is positionable in a releasing position, wherein the user urges a back end of said plunger forwardly or said plunger is spring-loaded such that said plunger shall move towards an open back end of said tubular housing, wherein a front end of a plurality of prongs moves away from each other as said plurality of prongs slides forwardly along an inner surface of an outer wall of said tubular housing;

wherein a rear end of the cigarette is inserted in said open front end of said tubular housing, wherein said plunger is positioned in said piercing position, wherein said front end of said plurality of prongs pierces an outer surface of the cigarette around an entire circumference of the rear end of the cigarette, and wherein the cigarette delivers a reduced amount of nicotine to the user.

* * * * *